US007729623B2

(12) United States Patent
Park

(10) Patent No.: US 7,729,623 B2
(45) Date of Patent: Jun. 1, 2010

(54) IMAGE FORMING APPARATUS AND IMAGE FORMING METHOD THEREOF

(75) Inventor: Young-jin Park, Bucheon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 185 days.

(21) Appl. No.: 11/945,402

(22) Filed: Nov. 27, 2007

(65) Prior Publication Data

US 2008/0304837 A1 Dec. 11, 2008

(30) Foreign Application Priority Data

Jun. 7, 2007 (KR) ..... 10-2007-0055627

(51) Int. Cl.
*G03G 15/00* (2006.01)

(52) U.S. Cl. ..... 399/25; 399/26; 399/51

(58) Field of Classification Search ..... 399/25, 399/26, 27, 46, 51, 53, 12, 82
See application file for complete search history.

(56) References Cited

U.S. PATENT DOCUMENTS 6,014,530 A * 1/2000 Tsunemi ..... 399/53
7,095,966 B2 * 8/2006 Adachi ..... 399/27
7,430,378 B2 * 9/2008 Inami et al. ..... 399/12
2001/0004423 A1 * 6/2001 Kakeshita et al. ..... 399/24
2002/0188413 A1 12/2002 Borg

FOREIGN PATENT DOCUMENTS

EP 1 211 575 A1 6/2002
JP 08069212 3/1996

OTHER PUBLICATIONS

European Search Report issued Oct. 13, 2008 in Europe Application No. 08102181.8.

* cited by examiner

*Primary Examiner*—Sophia S Chen
(74) *Attorney, Agent, or Firm*—Stanzione & Kim, LLP

(57) ABSTRACT

An image forming apparatus including an image forming unit which comprises a cartridge having a toner therein to form an image and a controller to control the image forming unit to increase a density of the image to be formed, if it is determined that a standard of the cartridge does not meet a usage requirement.

18 Claims, 4 Drawing Sheets

IMAGE FORMING APPARATUS AND IMAGE FORMING METHOD THEREOF

CROSS-REFERENCE TO RELATED APPLICATIONS

This application claims priority under 35 U.S.C.§119(a) from Korean Patent Application No. 10-2007-0055627, filed on Jun. 7, 2007 in the Korean Intellectual Property Office, the disclosure of which is incorporated herein in its entirety by reference.

BACKGROUND OF THE INVENTION

1. Field of the Invention

Apparatuses and methods consistent with the present general inventive concept relate to an image forming apparatus and an image forming method thereof, and more particularly, to an image forming apparatus to identify an unwarranted toner, and an image forming method thereof.

2. Description of the Related Art

An image forming apparatus forms an image based on printing data. An image forming unit of the image forming apparatus forms an image. The image forming unit includes a photosensitive body which forms an electrostatic latent image thereon, a light scanner which scans light to form the electrostatic latent image on the photosensitive body, a developing part which applies a developer to the electrostatic latent image formed on the photosensitive body, and a cartridge which stores toner therein.

A user may purchase a cheap unwarranted toner for the image forming apparatus. However, the unwarranted toner has characteristics different from a warranted toner. Since the durability of the photosensitive body and the developing part of the image forming unit is designed corresponding to an amount of the warranted toner which is provided initially, the frequent use of the unwarranted toner may cause unnecessary wear of the photosensitive body and the developing part. Also, the cleaning and charging operations of the photosensitive body is not performed properly, thereby deteriorating quality of an image formed by the image forming unit.

If the image is deteriorated as described above, a user may not perceive that the unwarranted toner is the cause. Instead, a user may ascribe the problem to the image forming apparatus itself. Also, an improper development to the photosensitive body due to the unwarranted toner may contaminate the image forming apparatus by scattering of the toner and carrier carrying the toner.

Thus, a conventional image forming apparatus adopts a method of not outputting an image when reaching a critical value in durability of the photosensitive body and to prevent the developing part from using the unwarranted toner. However, this method is against a law in some countries including Europe. Therefore, it is necessary to maintain a quality of an image at a certain level even if the unwarranted toner is used.

SUMMARY OF THE INVENTION

The present general inventive concept provides an image forming apparatus to maintain quality of an image at a certain level even if using an unwarranted toner, and an image forming method thereof.

The present general inventive concept also provides an image forming apparatus which is prevented from being contaminated, even if a developer is not properly developed to a photosensitive body due to an unwarranted toner, and a toner and a carrier carrying the toner are scattered, and an image forming method thereof.

Additional aspects and/or utilities of the present general inventive concept will be set forth in part in the description which follows and, in part, will be obvious from the description, or may be learned by practice of the present general inventive concept.

The foregoing and/or other aspects of the present general inventive concept can be achieved by providing an image forming apparatus including an image forming unit which includes a cartridge having a toner therein to form an image and a controller to control the image forming unit to increase a density of the image to be formed if it is determined that a standard of the cartridge does not meet a usage requirement.

The image forming unit may further include a photosensitive body and a light scanner to scan light to the photosensitive body, and a developing unit to apply a developer to the photosensitive body, wherein the controller determines the density of the image based on a lifetime of at least one of the photosensitive body and the developing unit.

The controller may calculate the lifetime of the photosensitive body and the developing unit based on a number of recording media output by the image forming unit.

The controller may control the light scanner to increase an intensity of light scanned by the light scanner to a preset level, if it is determined that the standard of the cartridge does not meet the usage requirement.

The controller may block a toner saving mode, if it is determined that the standard of the cartridge does not meet the usage requirement.

The image forming apparatus may further include a UI generator to generate a user interface to display the lifetime of at least one of the photosensitive body and the developing unit, and a display unit to display the generated user interface thereon.

The foregoing and/or other aspects and utilities of the present general inventive concept can also be achieved by providing an image forming method of an image forming apparatus which includes an image forming unit having a cartridge having a toner therein to form an image, including determining whether a standard of the cartridge meets a usage requirement and raising a density of the image to be formed, if it is determined that the standard of the cartridge does not meet the usage requirement.

The image forming unit may further include a photosensitive body and a light scanner to scan light to the photosensitive body, and a developing unit to apply a developer to the photosensitive body, and the raising the density of the image includes determining the density of the image based on a lifetime of at least one of the photosensitive body and the developing unit.

The raising the density of the image may include calculating the lifetime of the photosensitive body and the developing unit based on a number of recording media output by the image forming unit.

The raising the density of the image may include increasing an intensity of light scanned by the light scanner to a preset level, if it is determined that the standard of the cartridge does not meet the usage requirement.

The raising the density of the image may include blocking a toner saving mode, if it is determined that the standard of the cartridge does not meet the usage requirement.

The image forming method may further include generating and displaying a user interface to inform the lifetime of at least one of the photosensitive body and the developing unit.

The foregoing and/or other aspects and utilities of the general inventive concept may also be achieved by providing an image forming apparatus usable with a cartridge having toner, the image forming apparatus comprising a photosensitive body, a developing unit cooperating with the photosensitive body to form an image and a controller to control a density of the image so that a lifetime of the photosensitive body and the developing unit correspond to an amount of the toner remaining in the cartridge.

The foregoing and/or other aspects and utilities of the general inventive concept may also be achieved by providing an image forming apparatus comprising a receiving portion to receive a cartridge, a determining unit to determine whether the cartridge does not conform to a predetermined usage requirement and a controller to vary a density of an image to be formed based on the determination that the cartridge does not conform to the predetermined usage requirement.

The foregoing and/or other aspects and utilities of the general inventive concept may also be achieved by providing a computer-readable recording medium having embodied thereon a computer program to execute a method, wherein the method comprises determining whether a standard of a cartridge of the image forming apparatus meets a usage requirement and raising a density of the image to be formed based on a determination that the standard of the cartridge does not meet the usage requirement.

BRIEF DESCRIPTION OF THE DRAWINGS

The above and/or other aspects and utilities of the present general inventive concept will become apparent and more readily appreciated from the following description of the embodiments, taken in conjunction with the accompany drawings of which.

DETAILED DESCRIPTION OF THE PREFERRED EMBODIMENTS

Figure 1:
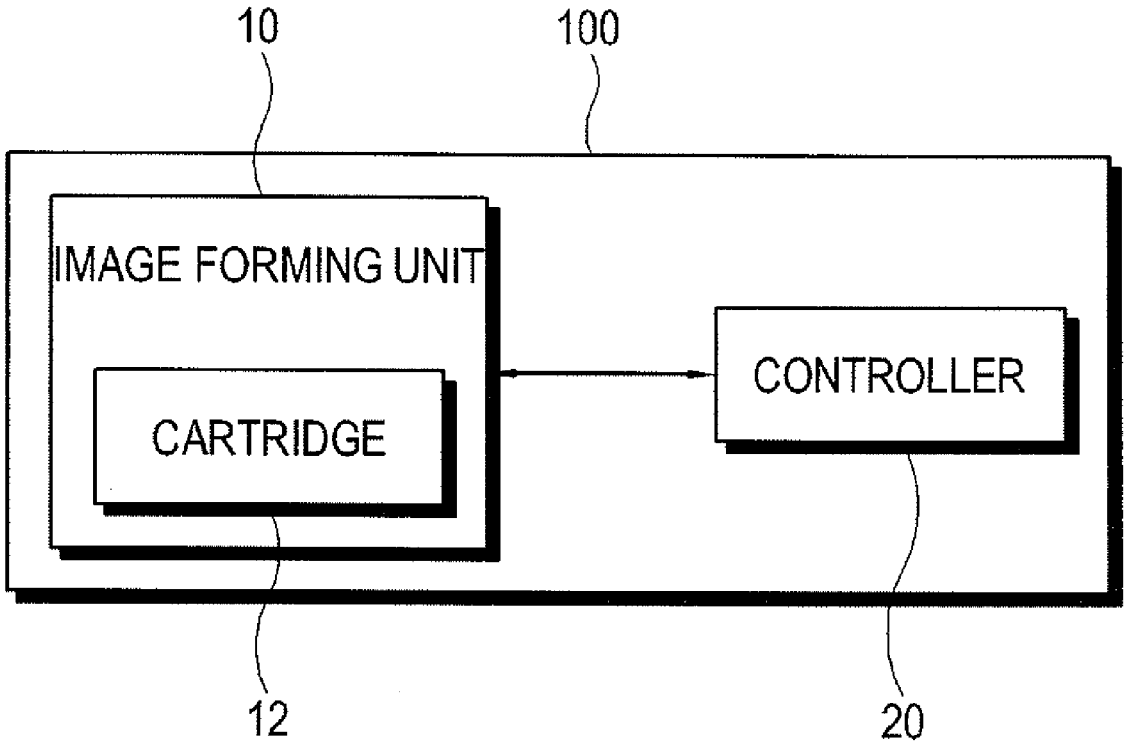
FIG. 1 is a block diagram illustrating an image forming apparatus according to an exemplary embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram of an image forming apparatus 100 according to an exemplary embodiment of the present general inventive concept. As illustrated therein, the image forming apparatus 100 according to the present exemplary embodiment includes an image forming unit 10 and a controller 20.

The image forming unit 10 includes a cartridge 12 to store a toner therein to form an image, and to form an image based on printing data. The image forming unit 10 can further include a photosensitive body 14, a developing unit 16 and a light scanner 18.

The photosensitive body 14 forms a predetermined image thereon. If a charger (not illustrated) charges a surface of the photosensitive body 14 with a negative charge, the light scanner 18 which is described below scans light to the photosensitive body 14 to form an electrostatic latent image thereon. The developing unit 16 applies a developer to the photosensitive body 14 forming the electrostatic latent image thereon.

The light scanner 18 includes a light source module, a polygon mirror assembly and a reflection mirror, and scans a light including printing image information to the photosensitive body 14 to form the electrostatic latent image thereon. The controller 20 controls the light scanner 18 by adjusting an amount of light or a width of a light scanning section to adjust a density of the image.

If it is determined that a standard of the cartridge 12 does not meet a usage requirement, the controller 20 controls the image forming unit 10 to raise density of the image to be formed. The controller 20 according to the present embodiment includes a determiner 22 to determine whether the standard of the cartridge 12 meets the usage requirement. The controller 20 may be embodied by a microcomputer or software.

The controller 20 may raise intensity of the light scanned by the light scanner 18, i.e. raise an amount of light to a preset level, or increase a width of an image forming section, thereby raising the density of the image. The controller 20 may control the density of the image so that a lifetime of the photosensitive body 14 and the developing unit 16 of the image forming unit 10 corresponds to remaining toner of the cartridge 12. That is, the toner of the cartridge 12 is fully consumed before the lifetime of the photosensitive body 14 and the developing unit 16 reaches a critical value, thereby preventing quality deterioration of the image due to wear of the photosensitive body 14 and the developing unit 16.

If the determiner 22 determines that the standard of the cartridge 12 does not meet the usage requirement, the controller 20 forcibly blocks a toner saving mode even if a user chooses the toner saving mode to save the toner, thereby maintaining the density of the image formed by the image forming unit 10 above a certain level. The operation of the controller 20 according to another embodiment of the present general inventive concept will be described in detail with reference to FIG. 3.

As described above, the image forming apparatus 100 according to the present embodiment increases the usage amount of the toner if the toner of the cartridge 12 is not a warranted toner, and consumes the toner before the lifetime of the photosensitive body 14 and the developing unit 16 reaches the critical value, thereby minimizing deterioration of the image formed by the image forming unit 10.

Figure 2:
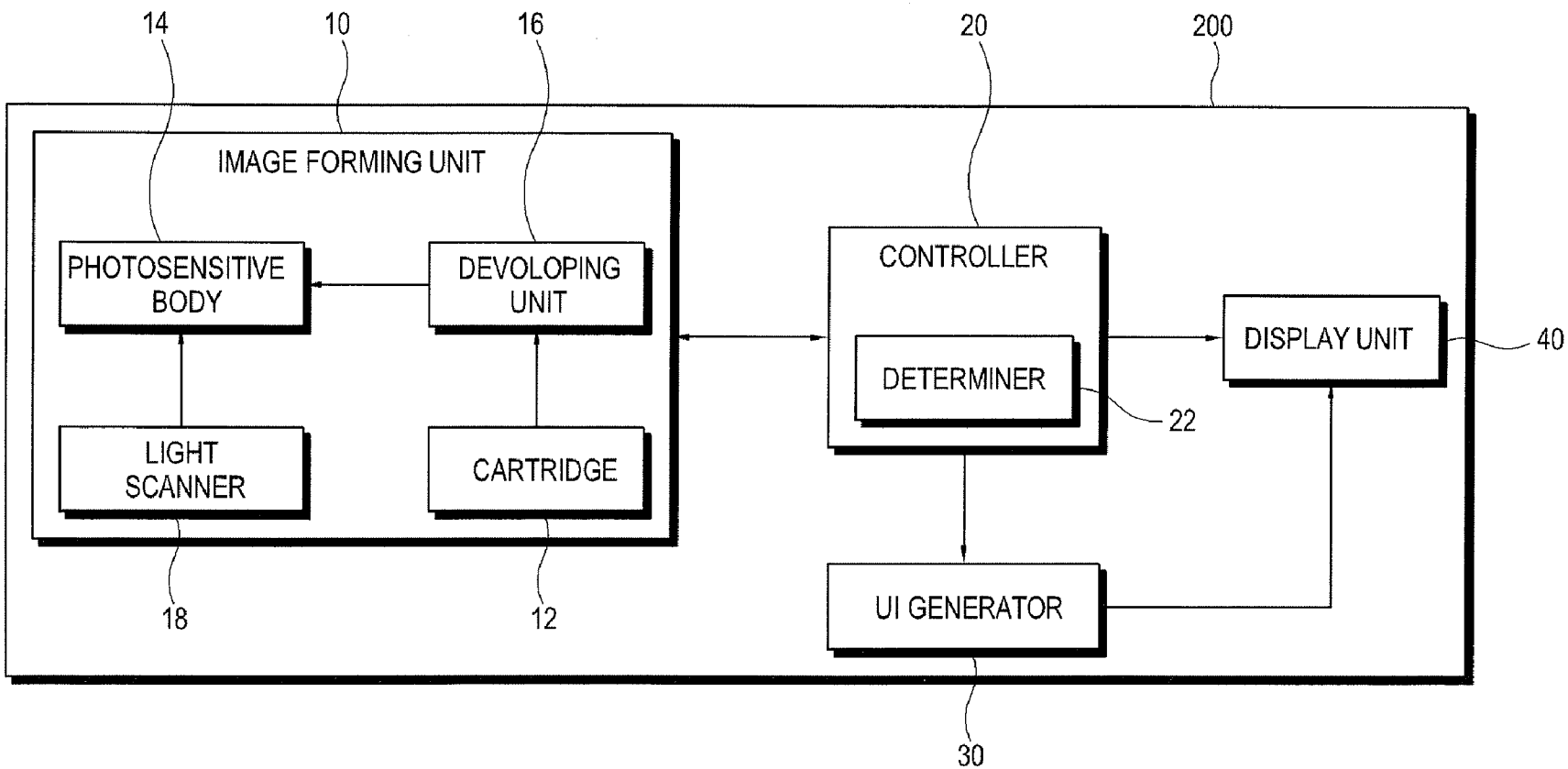
FIG. 2 illustrates a configuration illustrating an image forming apparatus according to another exemplary embodiment of the present general inventive concept.

FIG. 2 is a block diagram of an image forming apparatus 200 according to another exemplary embodiment of the present general inventive concept. As illustrated therein, the image forming apparatus 200 according to the present embodiment includes a user interface (UI) generator 30 and a display unit 40.

The UI generator 30 generates a UI to display the lifetime of at least one of a photosensitive body 14 and a developing unit 16. The display unit 40 displays the UI generated by the UI generator 30. The display unit 40 according to the present embodiment, for example, includes a liquid crystal display (LCD) which is provided at one side of the image forming apparatus 200. The UI generator 30 and the display unit 40 according to the present embodiment may be provided in an external host device (not illustrated) connected with the image forming apparatus 200.

The UI generator 30 may generate a UI to display the lifetime per stage calculated by the control of the controller 20, and may generate a UI to inform, for example, a user that the calculated lifetime reaches a predetermined critical value.

Figure 3:
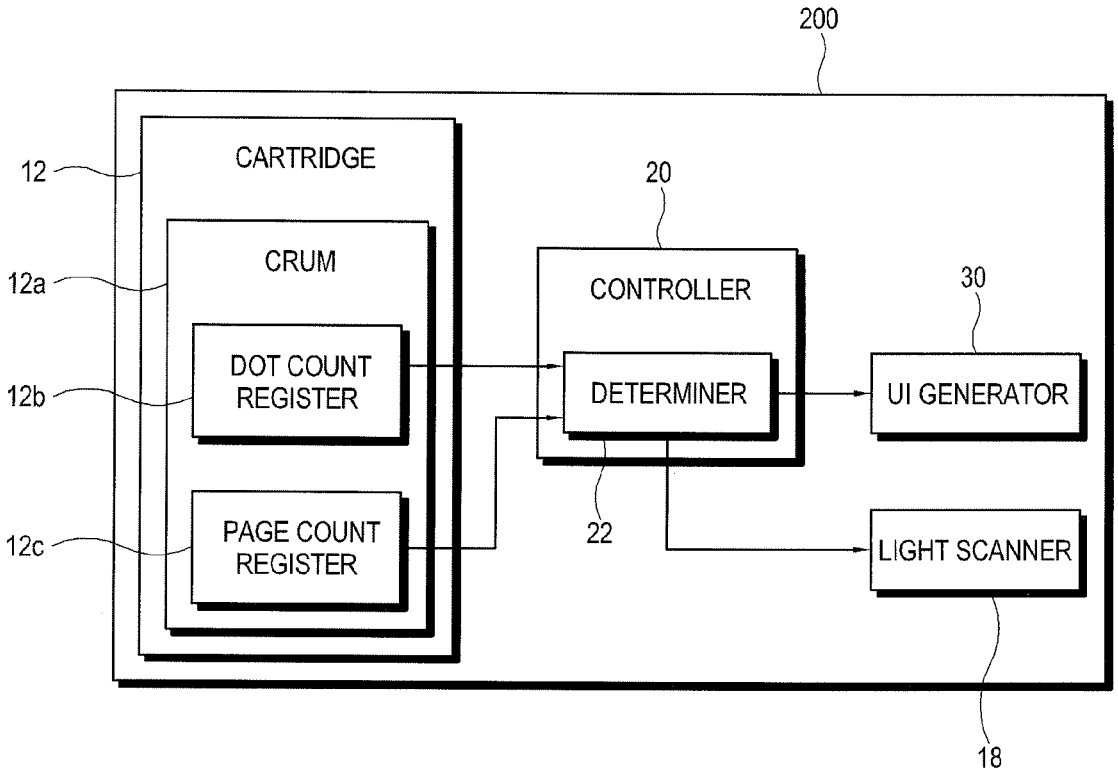
FIG. 3 is a block diagram illustrating an operation of a controller of the image forming apparatus according to another exemplary embodiment of the present general inventive concept.

Hereinafter, the operation of the controller 20 of the image forming apparatuses 100 and 200 according to another embodiment of the present general inventive concept will be described in detail with reference to FIG. 3. As illustrated therein, the cartridge 12 of the image forming unit 10 according to the present embodiment includes a customer replacement unit monitor (CRUM) 12*a*, and a dot count register 12*b* and a page count register 12*c* which are included in the CRUM 12*a*.

The dot count register 12*b* counts a number of dots formed in a recording medium while the page count register 12*c* counts a number of recording media output by the image forming unit 10.

The determiner 22 of the controller 20 determines whether the standard of the cartridge 12 meets the usage requirement, based on dot counting information and page counting information of the cartridge 12. More specifically, the determiner 22 determines that the cartridge 12 is recharged and does not meet the usage requirement, based on a number of pages counted by the page count register 12*c*, if a residual amount of the toner in the cartridge 12 is larger than a durability critical value of the photosensitive body 14 and the developing unit 16 of the image forming unit 10.

If the determiner 22 determines that the cartridge 12 does not meet the usage requirement, the controller 20 increases the intensity of light scanned by the light scanner 18 to the preset level to raise the density of the image formed on the photosensitive body 14. The controller 20 may control the light scanner 18 to increase the width of the image forming section of the photosensitive body 14 to the preset level, thereby increasing the density of the image.

The controller 20 may control the UI generator 30 to generate the UI to be displayed on the display unit 40 if the toner of the cartridge 12 is an unwarranted product. If the durability of the photosensitive body 14 and the developing unit 16 decreases due to the unwarranted toner, the controller 20 may control to display the UI on the display unit 40 periodically. If the durability of the photosensitive body 14 and the developing unit 16 reaches the critical value, the controller 20 may inform a user through the UI.

Figure 4:
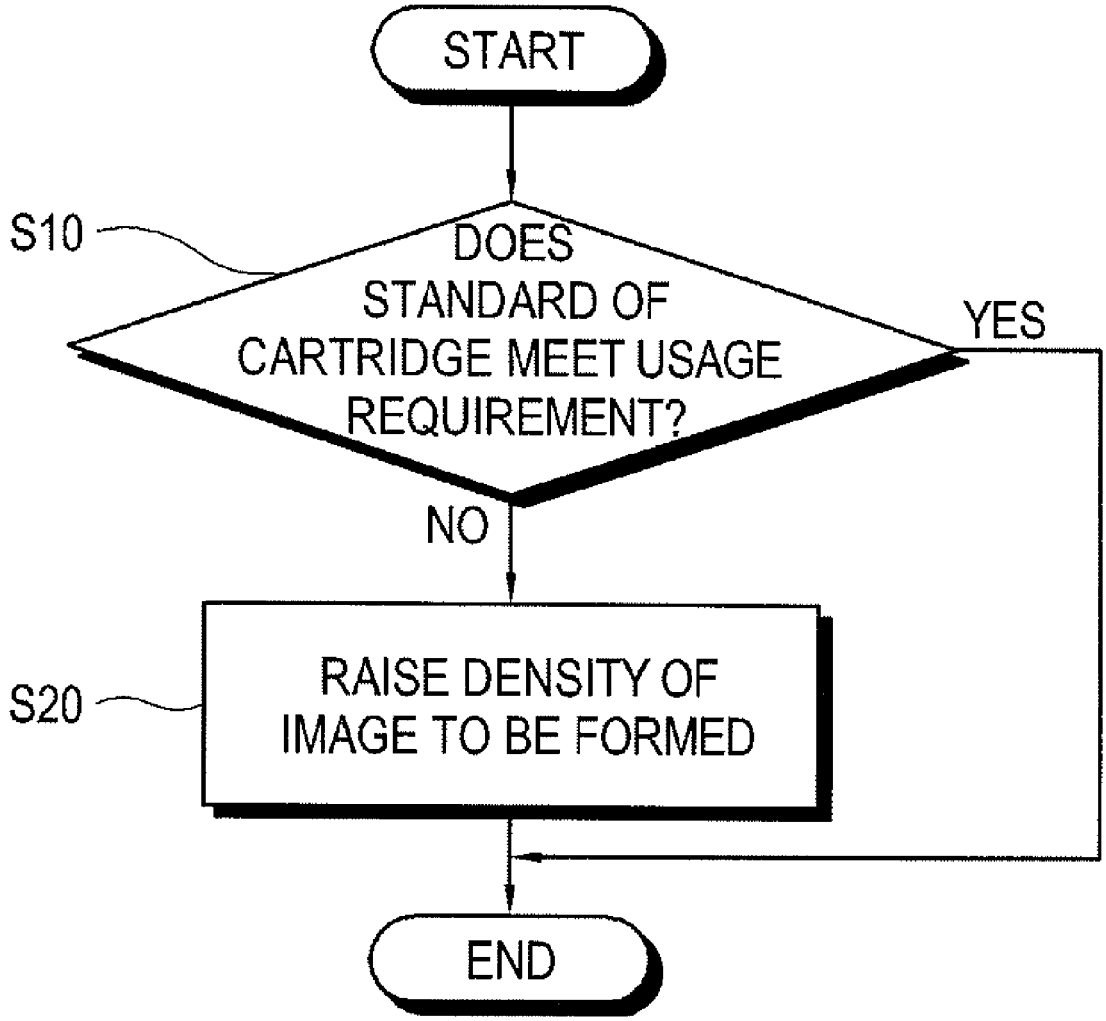
FIG. 4 is a flowchart which illustrates an image forming method of the image forming apparatus according to another exemplary embodiment of the present general inventive concept.

Hereinafter, the image forming method of the image forming apparatuses 100 and 200 according to another embodiment of the present general inventive concept will be described with reference to FIG. 4.

First, the controller 20 determines whether the standard of the cartridge 12 meets the usage requirement (operation S10). If the standard of the cartridge 12 does not meet the usage requirement, the controller 20 raises the density of the image formed by the image forming unit 10 (operation S20).

At operation S20, the density of the image may be determined by the lifetime of at least one of the photosensitive body 14 and the developing unit 16. The lifetime of the photosensitive body 14 and the developing unit 16 may be calculated based on the number of the recording media output by the image forming unit 10.

If it is determined at operation S20 that the standard of the cartridge 12 does not meet the usage requirement, the controller 20 may block the toner saving mode. In another exemplary embodiment of the present invention, the blocking of the toner saving mode may be performed between the operation S10 and the operation S20. The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As described above, various embodiments of the present general inventive concept provide an image forming apparatus to maintain quality of an image at a predetermined level even if using an unwarranted toner, and an image forming method thereof.

Also, various embodiments of the present general inventive concept provide an image forming apparatus to increase an amount of a toner usage if an unwarranted toner is used.

The present general inventive concept provide an image forming apparatus to increase an amount of an unwarranted toner usage of an image forming unit and to prevent a decrease in durability of a photosensitive body and a developing unit of the image forming unit, and an image forming method thereof.

Further, various embodiments of the present general inventive concept provide an image forming apparatus which is prevented from being contaminated by scattered toner and carrier carrying the toner from an improper development to a photosensitive body due to an warranted toner, and an image forming method thereof.

Although various exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus, comprising:

an image forming unit which comprises a cartridge having a toner therein to form an image; and a controller to control the image forming unit to increase a density of the image to be formed, if it is determined that a standard of the cartridge does not meet a usage requirement, wherein the controller blocks a toner saving mode, if it is determined that the standard of the cartridge does not meet the usage requirement.

2. The image forming apparatus according to claim 1, wherein the image forming unit further comprises:

a photosensitive body and a light scanner to scan light to the photosensitive body, and a developing unit to apply a developer to the photosensitive body, wherein the controller determines the density of the image based on a lifetime of at least one of the photosensitive body and the developing unit.

3. The image forming apparatus according to claim 2, wherein the controller calculates the lifetime of the photosensitive body and the developing unit based on a number of recording media output by the image forming unit.

4. The image forming apparatus according to claim 2, wherein the controller controls the light scanner to increase an intensity of light scanned by the light scanner to a preset level, if it is determined that the standard of the cartridge does not meet the usage requirement.

5. The image forming apparatus according to claim 2, further comprising:

a user interface (UI) generator to generate a user interface to display the lifetime of at least one of the photosensitive body and the developing unit, and a display unit to display the generated user interface thereon.

6. An image forming method of an image forming apparatus, the method comprising:

determining whether a standard of a cartridge of the image forming apparatus meets a usage requirement; and raising a density of the image to be formed, if it is determined that the standard of the cartridge does not meet the usage requirement, wherein the raising the density of the image comprises:

blocking a toner saving mode, if it is determined that the standard of the cartridge does not meet the usage requirement.

7. The image forming method according to claim 6, wherein:

the image forming unit further comprises:

an image forming unit including a photosensitive body and a light scanner to scan light to the photosensitive body; and a developing unit to apply a developer to the photosensitive body; and the raising the density of the image comprises:

determining the density of the image based on a lifetime of at least one of the photosensitive body and the developing unit.

8. The image forming method according to claim 7, wherein the raising the density of the image comprises:

calculating the lifetime of the photosensitive body and the developing unit based on a number of recording media output by the image forming unit.

9. The image forming method according to claim 7, wherein the raising the density of the image comprises:

increasing an intensity of light scanned by the light scanner to a preset level, if it is determined that the standard of the cartridge does not meet the usage requirement.

10. The image forming method according to claim 7, further comprising:

generating and displaying a user interface to inform the lifetime of at least one of the photosensitive body and the developing unit.

11. An image forming apparatus usable with a cartridge having toner, the image forming apparatus comprising:

a photosensitive body;

a developing unit cooperating with the photosensitive body to form an image; and a controller to control a density of the image so that a lifetime of the photosensitive body and the developing unit correspond to an amount of the toner remaining in the cartridge, wherein the controller fully consumes the toner in the cartridge before the lifetime of the photosensitive body and the developing unit reaches a critical value.

12. An image forming apparatus, comprising:

a receiving portion to receive a cartridge;

a determining unit to determine whether the cartridge does not conform to a predetermined usage requirement; and a controller to vary a density of an image to be formed based on the determination that the cartridge does not conform to the predetermined usage requirement, wherein the controller blocks a toner saving mode based on the determination that the cartridge does not conform to the predetermined usage requirement.

13. The image forming apparatus according to claim 12, wherein the controller varies the density of an image by increasing the density of the image.

14. The image forming apparatus according to claim 12, wherein the determining unit determines whether the cartridge does not conform to a predetermined usage requirement based on at least one of dot counting information and page counting information.

15. An image forming apparatus, comprising:

an image forming unit to form an image using a toner; and a controller to control the image forming unit to adjust a density of the image according to a standard of the image forming unit and a usage requirement of the toner, wherein the controller blocks a toner saving mode if it is determined that the image forming unit does not meet the usage requirement.

16. The image forming apparatus according to claim 15, wherein the standard of the image forming unit is a lifetime of the image forming unit, and the usage requirement of the toner is a remaining toner.

17. The image forming apparatus according to claim 15, wherein the image forming unit comprises:

a photosensitive body, a light scanner, and a cartridge containing the toner, and the standard of the image forming unit is a standard of at least one of the photosensitive body, the light scanner, and the cartridge.

18. The image forming apparatus according to claim 17, wherein the image forming unit comprises a light scanner and a photosensitive body, and the controller controls the light scanner to adjust an intensity of light to be scanned on the photosensitive body to raise the density of the image to be formed, if it is determined that the cartridge does not meet the usage requirement.

* * * * *